United States Patent [19]

Corti et al.

[11] Patent Number: 4,954,254

[45] Date of Patent: Sep. 4, 1990

[54] METHOD AND APPARATUS FOR SEPARATION OF HETEROGENEOUS PHASES

[75] Inventors: Aldo Corti, Calgary, Canada; John A. Falcon, Milan, Italy

[73] Assignees: Gulf Canada Corporation; RTR Oil Sands (Alberta) Ltd., both of Calgary, Canada

[21] Appl. No.: 320,759

[22] Filed: Mar. 8, 1989

Related U.S. Application Data

[62] Division of Ser. No. 47,356, May 6, 1987, Pat. No. 4,828,688.

[51] Int. Cl.[5] ..... B01D 21/06

[52] U.S. Cl. ..... 210/209; 210/221.2; 210/521

[58] Field of Search ..... 261/93; 208/391; 210/521, 513, 209, 221.1, 221.2; 239/245

[56] References Cited

U.S. PATENT DOCUMENTS

| | | | |
|---|---|---|---|
| 2,458,061 | 1/1949 | Coulter | 261/93 |
| 2,585,608 | 2/1952 | Wieghart | 239/245 X |
| 4,545,892 | 10/1985 | Cymbalisty et al. | 208/391 |

*Primary Examiner*—Frank Spear

*Attorney, Agent, or Firm*—Darby & Darby

[57] ABSTRACT

The invention provides a process for extracting bitumen from oil sands. The process includes the step of conditioning the oil sands by adding hot water and steam to the oil sands. The conditioned oil sands are then introduced into a separation zone. Separation of the oil sands into a bitumen froth phase, a middlings phase and a tailings phase occurs in the separation zone. Water with air dissolved therein is continuously injected under pressure upwardly through the separation zone. The water is at a low temperature relative to the oil sands. At least two of the phases are then separately withdrawn from the separation zone.

2 Claims, 7 Drawing Sheets

METHOD AND APPARATUS FOR SEPARATION OF HETEROGENEOUS PHASES

This is a divisional of copending application Ser. No. 047,356, filed on May 6, 1987, now U.S. Pat. No. 4,828,688, issued May 9, 1989.

This invention relates to a method and apparatus for separation of heterogeneous phases, and more particularly to a modified water process and apparatus for extracting bitumen from oil sands.

Oil sands, also known as tar sands or bituminous sands, are sand deposits which are impregnated with bituminous oil. The largest known deposit in the world is in the Athabasca region in Alberta, Canada. Athabasca oil sands are a mixture of bitumen, solids and water. Bitumen content is variable, ranging from 0 to 20% with an average of 12%. Water content is normally between 3 and 5%. A substantial portion of the oil sands is situated near the surface, where it may readily be mined and processed to synthetic crude oil.

Several extraction methods to separate bitumen from the sand have been known for many years, but only those based on hot water treatment are commercially used at present. In their different configurations, the processes based on hot water treatment consist of several steps.

In the first step, known as the conditioning or digestion step, oil sands are mixed with alkaline hot water and (optimally) steam to form a pulp or a slurry.

In the second step, known as the separation step, the conditioned mixture of bitumen, water and solids separates into its components. The bulk of the sand-sized solids separates into a coarse solids or tailings phase and is withdrawn. Most of the bitumen floats to the surface of the mixture to form a bitumen froth phase and is recovered. A third phase, known as the middlings phase, containing part of the bitumen and part of the fine solids, is also withdrawn for further treatment. This treatment may include a scavenging or a flocculation/clarification stage.

In the third step, known as the froth clean-up step, most of the water and solids in the froth are separated from the bitumen before the bitumen itself is sent to an upgrader.

For optimum separation the objectives to be achieved are to withdraw the tailings phase with as little entrapped bitumen as possible; to recover the bituminous froth phase with as little entrained water and solids as possible; and to withdraw the middlings phase with as little bitumen carryover as possible.

In the prior art, the separation step of the process is generally carried out in a single vessel in which, in practice, it is difficult to achieve the above objectives. A single vessel can be used to provide satisfactory separation when good grade oil sands are processed. Good grade oil sands contain at least 13% bitumen and less than 10% fines. However, oil sands with higher amounts of clay and lower amounts of bitumen cannot be separated satisfactorily using a single vessel. This is because the clay in the oil sands tends to act as an emulsion stabilizer. With increasing amounts of clay in the oil sands, the bitumen droplet size decreases and the viscosity of the middlings phase increases, inhibiting the separation of bitumen from the tailings and middlings phases.

To decrease bitumen losses to the middlings and tailings, additional steps have been added to existing processes. In one such process disclosed in U.S. Pat. No. 4,545,892 (Cymbalisty), in addition to a scavenging treatment of the middlings stream, the solid tailings are recovered from the bottom of the first separation vessel and fed to a second separation vessel in series with the first one. Part of the bitumen entrapped in the tailings is recovered in the second separation vessel.

Another process (Cymbalisty U.S. Pat. No. 3,935,076) has been proposed in which the conditioned oil sands are first fed to a separation vessel in which coarse sand is backwashed with water and is separated from a liquid stream comprising both aqueous and hydrocarbon phases. The coarse solids are disposed and the liquid stream is passed to a second vessel where liquid/liquid separation between middlings and bituminous froth takes place. In this process, the recovery of bitumen entrained by the sand is accomplished only by the upward velocity of the liquid phase through the coarse solids.

In U.S. Pat. No. 3,951,799 (Anderson), a bitumen extraction process is shown wherein the middlings from the separation vessel are recycled to the bottom of the separation vessel. This method has the advantage of diluting the settled sand, but requires uniform distribution of the recycle through a static distributor.

U.S. Pat. No. 4,172,025 (Porteous et al) shows separate vessels for phase separation and air flotation.

In U.S. Pat. No. 3,963,599 (Davitt), all process streams are saturated with air, including the solid slurry, middlings and sludge accumulated at the bottom of the tailings pond. In this process, sophisticated equipment is required to pump and maintain the streams under pressure. Moreover, the streams are saturated at high temperatures, which is less efficient than saturating streams at low temperatures.

A different approach is shown in Canadian patent number 1,165,712 (Dente et al). Two separate streams, a liquid-rich stream and a solids-rich stream, are recovered during the conditioning step. Each stream is fed into a separate vessel. The liquid-rich stream is fed into an oil/water separator, and the solids-rich stream is fed to a desander. The bitumen entrapped in the solids-rich stream is released and is recovered at the top of the desander. This arrangement presents the advantage of splitting the bituminous froth load between two vessels instead of one. However, it is disadvantageous in that the solid-rich stream tends to be diluted with bitumen-contaminated middlings.

In all of the prior art processes, the coarse solids are discharged from the process at process temperature so that substantial amounts of the heat content of the stream are lost from the process.

It is an object of this invention to provide an improved method and apparatus for the recovery of bitumen from oil sands.

Accordingly, the invention provides a process for extracting bitumen from oil sands. The oil sands are first conditioned by adding alkaline hot water and optimally steam thereto. The conditioned sands are then introduced into a separation zone. In this zone, the oil sands are allowed to separate into a bitumen froth phase, a middlings phase and a tailings phase. Water is continuously passed upwardly through the separation zones. This water is under pressure and has dissolved air therein. The water is also at a low temperature relative to the conditioned oil sands. Subsequently, at least two of the phases are withdrawn separately from the separation zone.

The passing of water under pressure into the separation zone causes air dissolved in the water to be released as small bubbles due to the decrease in pressure and increase in temperature. These bubbles collide with the bitumen droplets entrapped in the settled solids in the tailings phase and carry the bitumen droplets to the bitumen froth phase. The injection of water also establishes a net upwards liquid flow extending through the entire separator which helps to carry upwards bitumen droplets not contacted by the air bubbles. The injection of water thereby increases the amount of bitumen in the froth. As the water is at a lower temperature than the solids-rich and liquid-rich streams and as it is also preferably injected directly below the interface between the middlings phase and the tailings phase where the solids settle, it also exchanges heat with the settling solids, thereby increasing the thermal efficiency of the process.

Preferably, the middlings are treated to remove impurities therefrom and obtain clarified water. Optionally, air may be dissolved in the clarified water and may then be recycled upstream through the separation zone. This clarified recycled water helps to carry air into the separation zone and give a net upstream liquid flow.

Preferably, the separation zone comprises a first separation zone and a second separation zone. The oil sands separate into a solids-rich stream and a liquid-rich stream after conditioning, and the solids-rich stream is introduced into the first separation zone and said liquids-rich stream is introduced into the second separation zone.

Preferably, the first separation zone which receives the solids-rich stream is a desander and the second separation zone which receives the liquid-rich stream is a froth/middlings separator.

The use of a separate desander and separator provides the advantage of decreasing the specific load of froth, middlings and tailings in each apparatus, thereby improving the separation of the three phases.

The water is preferably at a temperature ranging between 4° and 40° C. and has a pH in the range of 7 to 9.5. Most preferably the pH is between 8.5 and 9.0. The water is preferably saturated with air at a pressure of at least 250 kPa, preferably in the range 250 to 700 kPa, before entering the desander and the separator. The desander and separator vessels are preferably at atmospheric pressure. The location of injection of water is preferably chosen to be approximately just underneath the middlings/solids interface.

In another of its aspects, the invention provides a phase separation device to separate a feed into a tailings phase and at least one other phase. The device comprises a vessel wherein the feed separates into a tailings phase and at least one other phase. The vessel has a feed inlet to allow feed to enter the vessel, and outlets for each of the separated phases. A rake is rotatably mounted near the base of the vessel to rake the base of the vessel. A water injector is supported on the rake and rotatable therewith. This injector injects water with air dissolved therein under pressure at a location below the interface of the tailings phase and one of the other phases.

A preferred embodiment of the invention will now be described, by way of illustration only, with reference to the following drawings in which:

FIGS. 8A and 8B are side and front views respectively of another rake for use in the apparatus of FIG. 4; and FIGS. 9A and 9B are side and front views respectively of another rake for use in the apparatus in FIG. 4.

Figure 1:
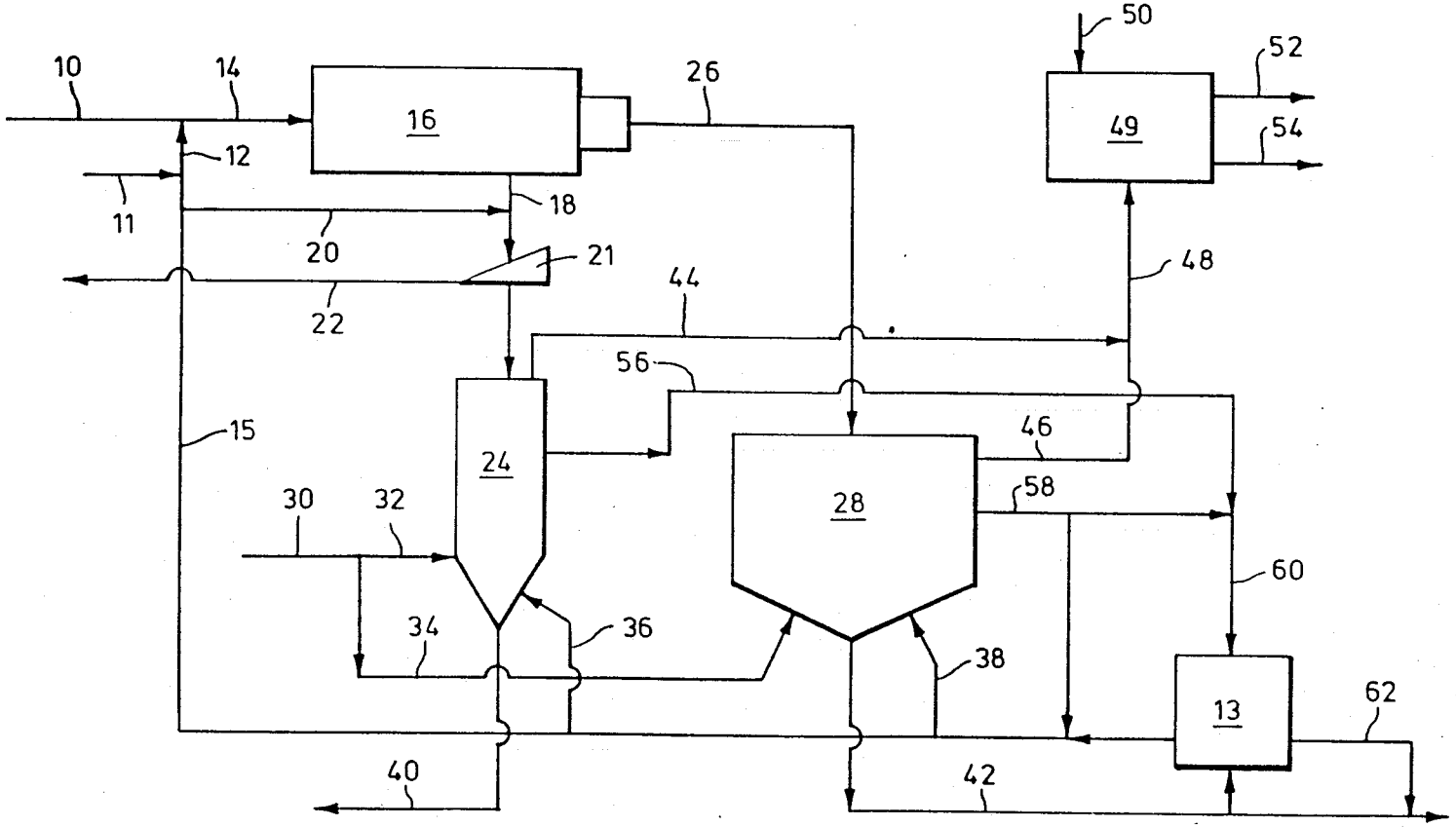
FIG. 1 is a schematic representation of a hot water process for extracting bitumen from oil sands according to the invention.

As can be seen in FIG. 1, oil sands are fed into an apparatus for carrying out a process of extracting bitumen from oil sands through a line 10. These oil sands are contacted with clarified recycle water through line 12 which is heated by steam from pipe 11. The recycle water is obtained from water treater 13 through line 15, as will be discussed later. The mixture of oil sands and hot water passes through pipe 14 to dioester 16. In the digester, the mixture separates into a liquid-rich stream and a solids-rich stream. The solids-rich stream passes through a pipe 18 and is diluted with water passing through pipe 20.

The solids-rich stream then passes through a screen 21, wherein larger particles are separated, passed through line 22 and discarded. The solids-rich stream is then fed into a desander 24. The liquid-rich stream is passed directly through line 26 to froth/middlings separator 28. Cold make-up water, preferably at about 4° C., at a pH of 7.0 and saturated with air at 700 kPa from a make-up water source is injected under moderate pressure, to keep the air in solution, through line 30 into the lower part of the desander 24 and into the separator 28 through pipes 32 and 34 respectively. Also, clarified recycle water at 60° C., at a pH of 9.0 and saturated with air at 700 kPa is injected under moderate pressure into the lower parts of the desander 24 and the separator 28 through pipes 36 and 38 respectively.

Separation of the solids-rich and liquid-rich streams occurs in both the desander 24 and the separator 28. Each of the streams separates into a bitumen froth phase which floats on the top, a tailings phase which settles in the bottom and a middlings phase intermediate between the froth and tailings phases.

In the base of both the desander 24 and the separator 28, a tailings stream is collected through pipes 40 and 42 respectively. The tailings stream from the desander 24 contains most of the coarse solids originally present in the oil sands, and some fine minerals and some hydrocarbons still entrapped in the coarse solid matrix. The tailings stream collected at the base of the separator 28 contains some coarse solids carried from the digester and some settled fine minerals Froth streams containing most of the bitumen originally present in the oil sands together with water and solids are collected at the top of both the desander 24 and the separator 26 through pipes 44 and 46 respectively. These lines are connected to combine the froth streams and the combined froth stream is fed to a conventional froth treatment apparatus 49 through pipe 48. In this apparatus, the bituminous froth is diluted with a light hydrocarbon added through line 50 and is treated for the removal of water and minerals which contaminate the bitumen. Diluted product exits from the froth treatment apparatus through pipe 52 and is sent to downstream operations. The water and minerals separated from the hydrocarbon phase exit the froth treatment apparatus through line 54 and are sent to disposal.

Middlings streams are withdrawn from both the desander 24 and the separator 28 at a location intermediate between the base and the top of each of the apparatuses through pipes 56 and 58 respectively. The middlings streams contain, in suspension, some hydrocarbon and part of the fine materials originally present in the oil sands and disaggregated in the digester. The pipes 56 and 58 are connected to combine the middlings streams, and the combined middlings stream is fed to a conventional water treatment apparatus 13 through pipe 60. This conventional water treatment apparatus 13 includes apparatus suitable for flocculation, clarification, centrifuging and settling. The resultant clarified water is saturated with air at a pressure of 700 kPa and recycled back into the apparatus through pipe 15 to lines 12, 36 and 38 as previously discussed. The sludge removed in the water treatment apparatus is withdrawn through pipe 62, combined with the tailings stream passing through pipe 42 and discarded.

Figure 2:
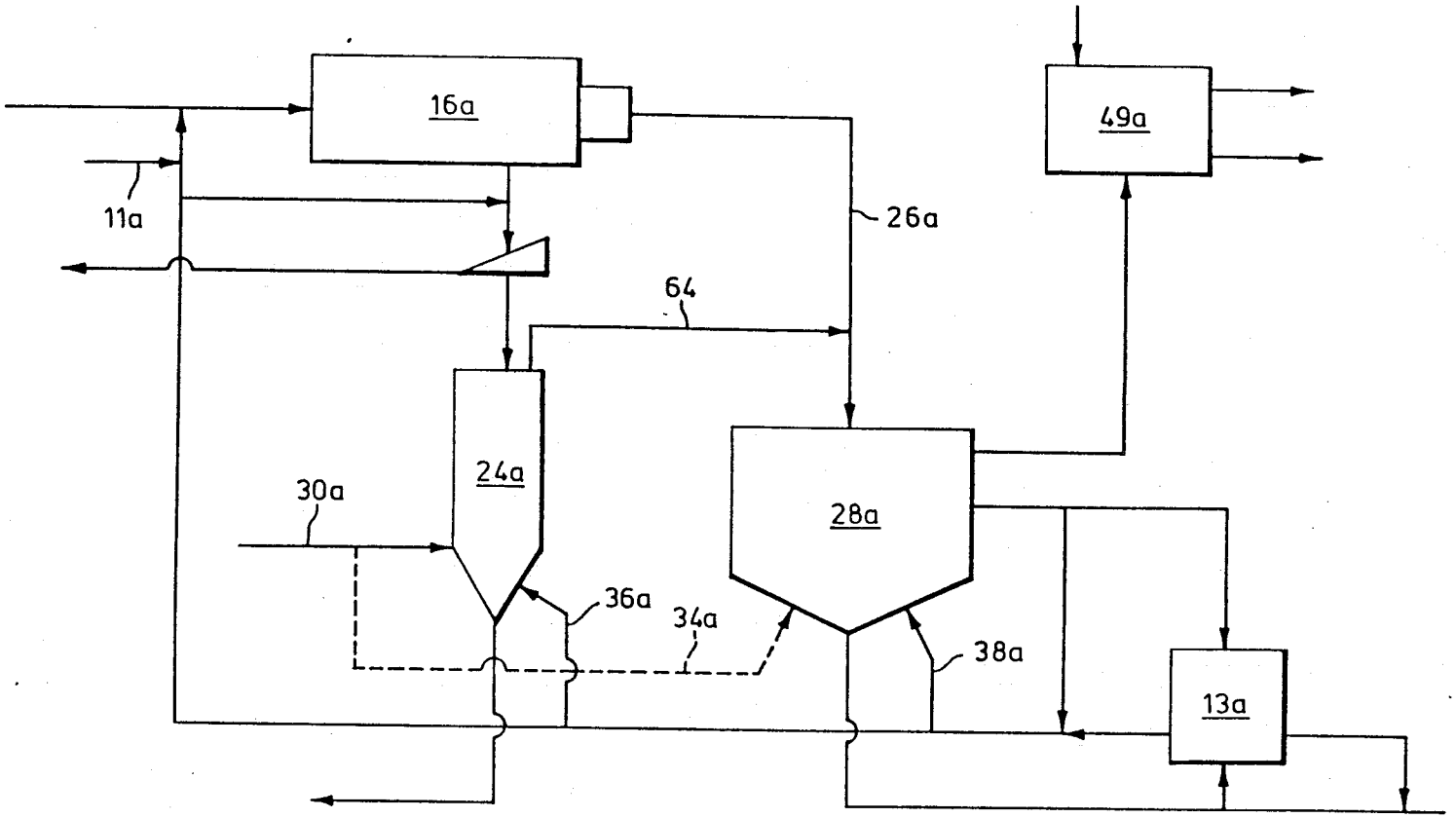
FIG. 2 is schematic representation of a hot water process for extracting bitumen from oil sands according to the invention, which is an alternative embodiment to that shown in FIG. 1.

FIG. 2 shows a modified arrangement of the process. Apparatus similar to the apparatus shown in FIG. 1 is indicated by the same reference numerals, followed by the suffix "a".

One difference between this modified arrangement and the arrangement of FIG. 1 is that a single stream is removed from the top of the desander **24*a* through pipe 64. This pipe is connected to pipe 26*a* carrying the liquid-rich stream from the digester 16*a* to form a single combined stream. The combined stream is fed into the separator 28*a*. Another difference is that make-up water from pipe 30*a* is only fed into the base of the desander 24*a* and not into the separator 28*a***.

The apparatus of FIG. 1 can be changed into the configuration of FIG. 2 simply by rearranging some of the piping.

The configuration of FIG. 2 is suitable for use when good grade oil sands are processed having a bitumen content of at least 13%, and a fines content of less than 10%. When good grade oil sand is used, there is less bitumen lost to the tailings stream and to the middlings stream, and therefore it is not necessary to inject make-up water into the separator **28*a*. As less water is necessary when processing good grade oil sands, the specific loads, of the desander 24*a* and the separator 28*a* can be reduced. The vessels can therefore be run in series rather than in parallel. As less bitumen is entrapped in the solids-rich stream with good grade oils, it is only necessary to remove a single liquid stream from the desander 26*a***.

Figure 3:
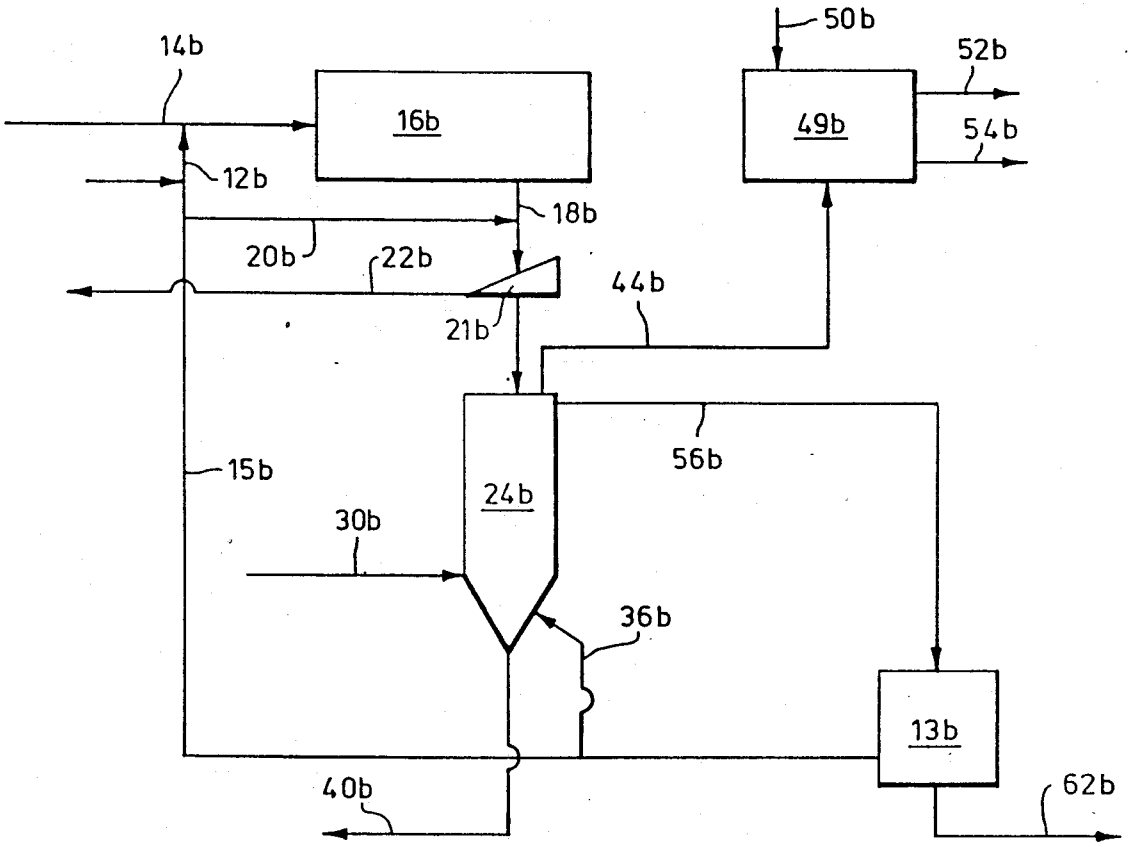
FIG. 3 is a schematic representation of a single vessel hot water process for extracting bitumen according to the invention, which is an alternative embodiment to that shown in FIG. 1.

FIG. 3 shows an alternative embodiment of the invention. Apparatus similar to the apparatus shown in FIG. 1 is indicated by the same reference numerals, followed by the suffix "b". In this embodiment, all of the effluent from digestor **16*b* is sent to a desander 24*b*. Cold make-up water and clarified water are introduced countercurrently into the desander 24*b*. A froth phase, a tailings phase and a middlings phase are formed in the desander. These phases are separately removed and treated as described above with respect to FIG. 1**. In this embodiment, a separator is not required. This embodiment is suitable for use with good grade oil sands.

Figure 4:
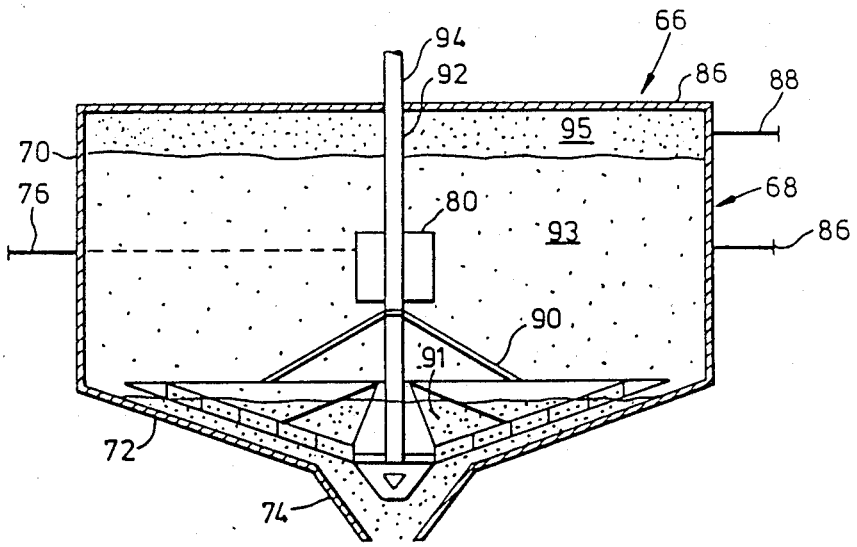
FIG. 4 is a schematic representation of a cross-section of a separation apparatus according to the invention.
Figure 5:
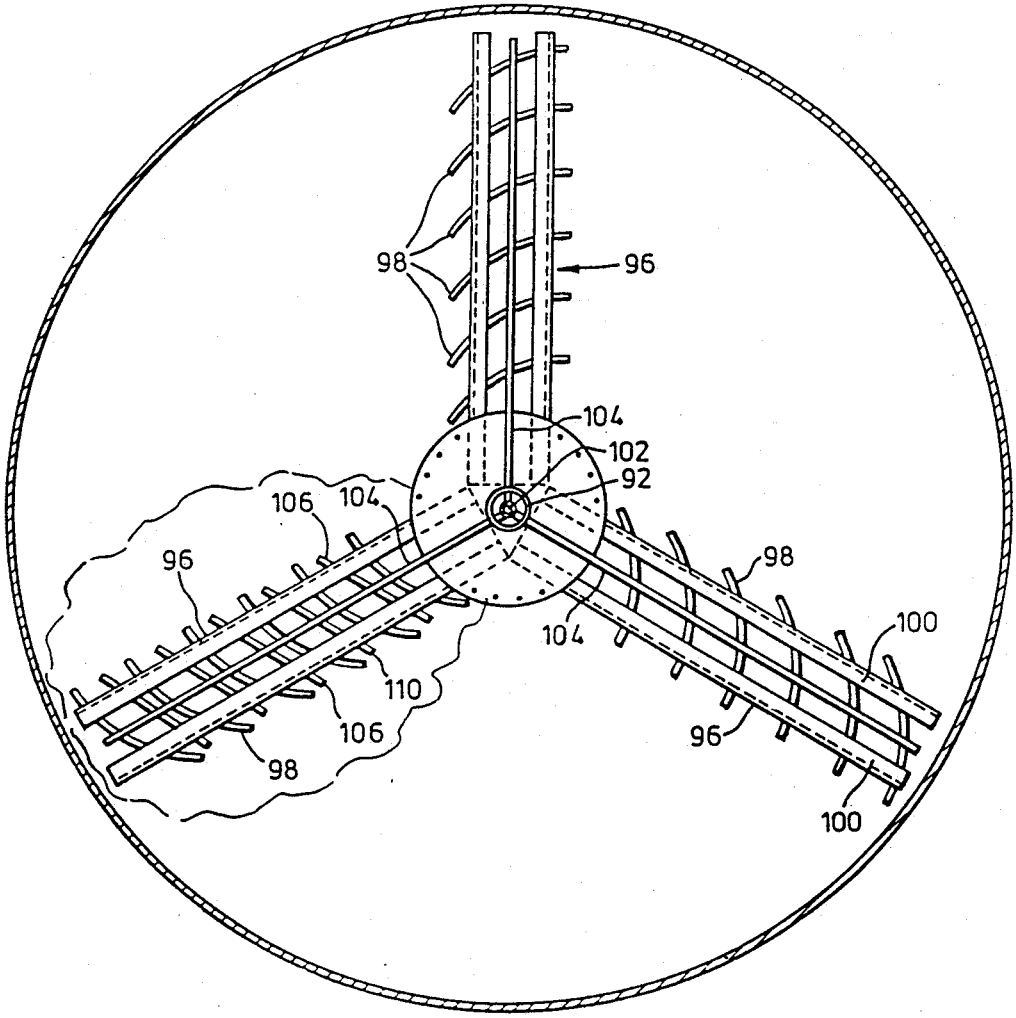
FIG. 5 is a top view of the separation apparatus of FIG. 4.

FIGS. 4 and 5 show a separation apparatus 66 particularly suitable for use with the process of the present invention. This apparatus 66 can either function as a desander 24 or as a separator 28. This apparatus 66 consists of a closed vessel 68 having a cylindrical wall 70, an inclined frustroconical base 72 and a frustroconical tailings outlet 74 at the centre of the base 72. A feed inlet pipe 76 extends through the wall 70, to a feed well 80 near the center of the vessel. At least two ,middlings outlets 82 (only one shown) are located around the periphery of the vessel imtermediate the base 72 and top 86 of the vessel. A froth outlet 88 is located near the top 86 of the vessel.

A rake 90 is disposed inside the vessel near the base 72 and includes a rotatable shaft 92 which extends from the base 72 through an opening 94 in the top 86 of the vessel 68. As can best been seen in FIG. 5, the shaft 92 has three radially extending arms 96 attached to the base thereof, each with six curved plate blades 98 mounted thereon at an angle of more than 45° to the arm 96. The arms 96 are made up of two facing, parallel, spaced channels.

The apparatus operates as follows. Feed enters the separator and settles into tailings 91, middlings 93 and froth phases 95. The rake 90 is adjustable in height so that the arms 96 are in the middlings phase 93 and the blades 98 are in the tailings 91 phase. The shaft 92 is rotated by suitable means, thereby rotating the arms 96 and blades 98. The blades 98 are mounted at a suitable angle to the arms 96 so as to push the tailings towards the tailings outlet 74.

The movement of the blades 98 in the tailings phase causes a zone of greater solids compaction in front of each blade 98 and a zone of lower solids compaction behind each blade 98. This action of the blades 98 allows some bitumen droplets trapped in the tailings to be freed.

Figure 6A:
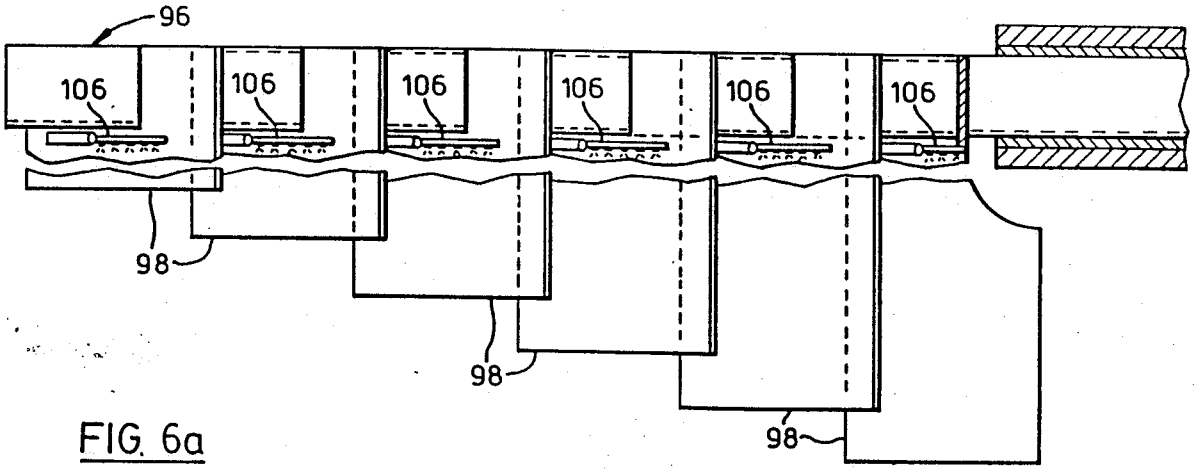
FIG. 6 is a top view of a rake for use in the apparatus of FIG. 4.
Figure 6B:
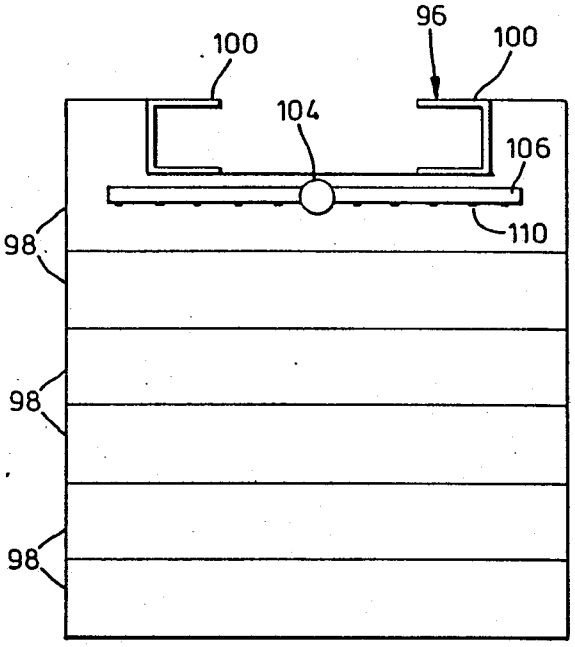

The rake arms also serve as supports for the injection of water containing dissolved air. FIGS. 6A, 6B, 7A and 7B show water injectors suitable for use with the apparatus of FIGS. 4 and 5. As can be seen in FIG. 6, a water pipe 102 coaxial with the rake shaft 92 and rotatable therewith extends downwardly into the vessel 68 and terminates adjacent to the arms 96. A number of headers 104, corresponding to the number of arms 96 extend radially from the water pipe 102 between the channels 100 of the arms 96. A plurality of liquid distributors are mounted on the headers 104 in such a manner that they are in fluid communication with the headers 104. Each of these distributors are positioned on the outermost side 105 of each of the blades 98 of the rake. As can be seen in FIGS. 6A, 6B, 7A and 7B, these distributors 106 consist of a length of pipe 108 with nozzles 110 therein.

In operation, as the rake shaft rotates, the water pipe 102 rotates so that the headers 104 and arms 96 rotate together. Water is then injected through the nozzles 110.

FIGS. 6A and 6B show an embodiment wherein distributors 106 are all at the same elevation. In this embodiment the blades 98 are of different heights to correspond to the shape of the base of the vessel.

Figure 7A:
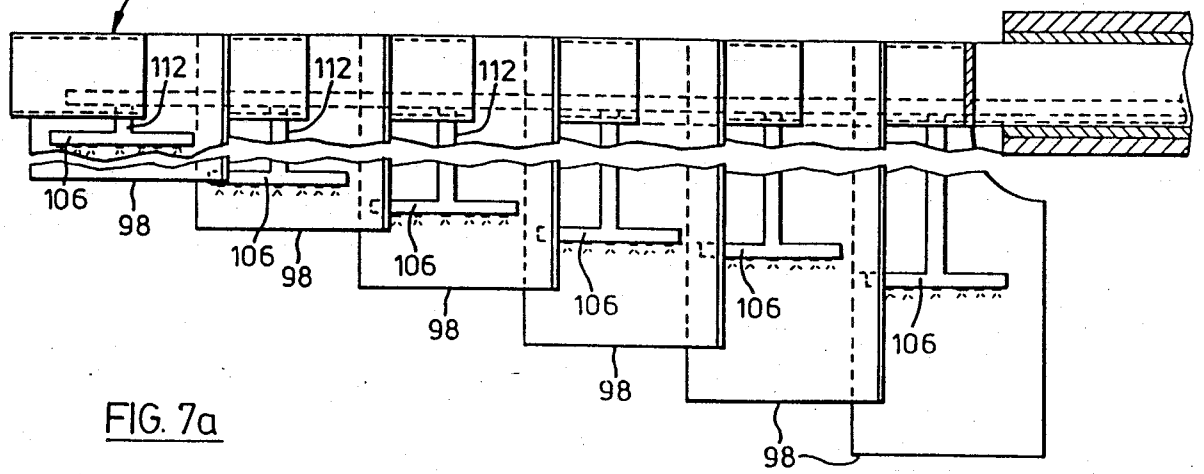
FIG. 7 is a top view of a part of another rake for use in the apparatus of FIG. 4.
Figure 7B:
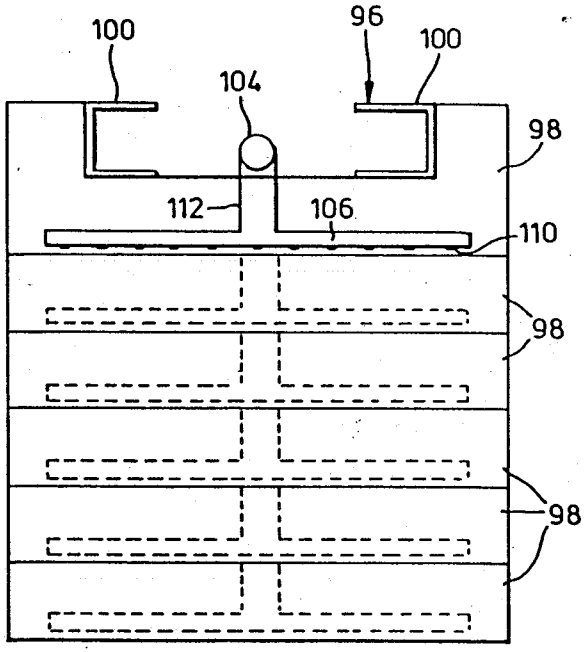

In the embodiment of FIGS. 7A and 7B, the distributors 106 are "T"-shaped with the tail 112 of each "T" being connected to the header 104. The length of the tails 112 varies with each distributor 106 so that the outermost distributors 106 are at a higher elevation than the innermost distributors 106.

It is to be appreciated that modifications can be made to the preferred embodiment within the scope of the invention as described and claimed. The distributors 106 may have holes punched therein or simple nipples instead of nozzles 110. There can be any number of arms 96, blades 98 and distributors 106. The arms and distributors can be either straight or curved. The distributors 106 could be located anywhere, although they are each preferably located on the outermost side of a respective blade 98.

The invention will be further described with reference to the following example.

EXAMPLE

A process similar to that shown in FIG. 1 was operated with a feed of 1,000 kg per hour. The process conditions in the desander and froth/middlings separation vessel are summarized in Tables 1 and 2 respectively. As can be seen from these tables, the bitumen content of the tailings phase is decreased when cold make-up water with air dissolved therein is passed countercurrently through the desander and froth/middlings separation vessel.

TABLE 1

DESANDER
BASED ON 1,000 KG/H OIL SANDS

| RUN | 1 | 2 |
|---|---|---|
| Desander Feed (Kg/H) | 1,716.0 | 1,716 |
| % bitumen | 2.38 | 2.40 |
| % solids | 43.00 | 42.80 |
| Make-up Water (Kg/H) | Nil | 294.3 |
| T °C. | — | 4 |
| P kPa | — | 700 |
| Desander Tails (Kg/H) | 1,135.3 | 1,130.00 |
| % bitumen | 0.81 | 0.39 |
| % solids | 63.74 | 62.85 |
| Desander Froth (Kg/H) | 56.3 | 60.3 |
| % bitumen | 47.25 | 46.98 |
| % solids | 5.75 | 6.15 |
| Desander Middlings (Kg/H) | 535.4 | 820.0 |
| % bitumen | 0.94 | 1.03 |
| % solids | 2.06 | 2.50 |

TABLE 2

FROTH/MIDDLINGS SEPARATOR
BASED ON 1,000 KG/H OIL SANDS

| RUN | 1 | 2 |
|---|---|---|
| Feed (Kg/H) | 1,540.1 | 1,512.5 |
| % bitumen | 5.33 | 5.43 |
| % solids | 7.50 | 7.70 |
| Clarified Water Recycle (Kg/H) | Nil | 325.0 |
| T °C. | — | 65 |
| P kPa | — | 600 |
| Separator Tails (Kg/H) | 124.8 | 130.5 |
| % bitumen | 0.80 | 0.38 |
| % solids | 58.22 | 55.65 |
| Separator Froth (Kg/H) | 139.5 | 140.7 |
| % bitumen | 49.25 | 48.65 |
| % solids | 4.66 | 4.80 |
| Separator Middlings (Kg/H) | 1,275.8 | 1,566.3 |
| % bitumen | 0.97 | 0.84 |
| % solids | 2.85 | 2.37 |

The embodiments of the invention in which an exclusive property or privilege is claimed are defined as follows:

1. A phase separation device to separate a feed into a tailings phase and at least one other phase comprising:

a feed inlet to allow said feed to enter the vessels;

a vessel wherein said feed separates into a tailings phase and at least one other phase;

outlets for each of the separated phases;

a rake rotatably mounted near the base of vessel to rake the tailings phase in the base of the vessel; and a water injector for injecting water with air dissolved therein under pressure, said injector being supported on said rake and rotatable therewith at a location directly below the interface of said tailings phase and said other phase.

2. The phase separation device of claim 1 wherein said rake comprises a rotatable central shaft with a plurality of arms mounted thereon, each of said arms having a plurality of blades mounted thereon, at an angle to said arms and wherein said water injection means comprises a rotatable central pipe coaxial with said shaft and having a plurality of headers connected thereto, said headers extending parallel to said arms, each of said headers having a plurality of water distributors mounted thereon, each of said distributors being located adjacent to a respective blade.

* * * * *